US006129015A

United States Patent [19]

Dewey

[11] Patent Number: 6,129,015

[45] **Date of Patent: *Oct. 10, 2000**

[54] METHOD AND APPARATUS FOR REGISTERING COLOR IN A PRINTING PRESS

[75] Inventor: Craig D. Dewey, River Hills, Wis.

[73] Assignee: Quad/Tech, Inc., Sussex, Wis.

[ * ] Notice: Under 35 U.S.C. 154(b), the term of this patent shall be extended for 1214 days.

[21] Appl. No.: 08/496,234

[22] Filed: Jun. 28, 1995

Related U.S. Application Data

[63] Continuation-in-part of application No. 08/156,293, Nov. 23, 1993, abandoned.

[51] Int. Cl.[7] ..... B41M 1/14; B41F 5/16; B41F 21/12; B41L 1/02

[52] U.S. Cl. ..... 101/211; 101/485; 101/481; 101/183

[58] Field of Search ..... 101/181, 211, 101/171, 174, 183, 216, 232, 248, 481, 485, 486, DIG. 46

[56] References Cited

U.S. PATENT DOCUMENTS

| | | | |
|---|---|---|---|
| 3,806,012 | 4/1974 | Roch | 226/2 |
| 4,532,596 | 7/1985 | Pugsley | 364/469 |
| 4,534,288 | 8/1985 | Brovman | 101/211 |
| 4,546,700 | 10/1985 | Kishner | 101/181 X |
| 4,596,468 | 6/1986 | Simeth | 356/400 |
| 4,736,680 | 4/1988 | Wales et al. | 101/426 |
| 4,852,485 | 8/1989 | Brunner | 101/211 |
| 4,887,530 | 12/1989 | Sainio | 101/181 |
| 5,056,430 | 10/1991 | Bayerlein et al. | 101/211 |
| 5,206,707 | 4/1993 | Ott | 356/402 |
| 5,237,394 | 8/1993 | Eaton | 356/402 |
| 5,331,438 | 7/1994 | Harrington | 358/500 |

*Primary Examiner*—Kimberly Asher
*Attorney, Agent, or Firm*—Michael Best & Friedrich LLP

[57] ABSTRACT

A method and apparatus for determining color registration in a multi-color printing press having a plurality of printing stations. A process black registration mark is formed in an identified area by positioning a plurality of color registration marks on top of each other. The process black registration mark is position in a portion of the image that is intended to be printed black, and preferably adjacent to a black ink image. The identified area is examined to determine whether the process black registration mark is properly positioned.

20 Claims, 3 Drawing Sheets

METHOD AND APPARATUS FOR REGISTERING COLOR IN A PRINTING PRESS

RELATED APPLICATIONS

This application is a continuation-in-part of U.S. patent application Ser. No. 08/156,293 filed Nov. 23, 1993, now abandoned.

FIELD OF THE INVENTION

The invention relates generally to color registration in a multi-color printing press.

BACKGROUND OF THE INVENTION

In multi-color printing, colors are laid down on a moving web by separate printing units which print in different colors such as cyan, yellow, magenta, and black. The images printed by the separate printing units must be printed one on top of the other. This is known as color registration.

Closed loop control of color registration has been previously proposed. See, for example, U.S. Pat. No. 4,546,700, issued to Kishner et al. and incorporated herein by reference. Kishner et al. discloses a method and apparatus for automatically sensing and maintaining registration of each of the color cylinders in a multi-color printing press. Predetermined register marks are printed in non-image areas on the sheet to be printed. A register mark for each process color is printed in the same location as a corresponding black reference register mark. The reference register marks are configured such that the average reflectance of the printed overlay will change as the registration of the color image changes with respect to the black image. The reflectance of each printed overlay is measured on the printing press, while the sheet is moving. One type of sensor that can be used for this measurement is an on-press densitometer. If desired, the reflectance information obtained thereby can be converted to a registration error signal and used to achieve automatic, closed-loop control of the position of each of the color cylinders.

See also, for example, U.S. Pat. No. 4,534,288, issued to Brovman and incorporated herein by reference. Brovman proposes a unified system for detecting misregistration and for ink density control in a four color printing press. A color bar having 136 square fields is printed in a non-image area normally trimmed or otherwise removed from the finished product. The color bar includes register fields. The percentage of non print area in register indicia is detected and used to control register adjustment mechanisms of the press.

As evidenced by the Kishner et al. and Brovman patents, closed loop color registration systems typically require marks to be printed outside the image areas of a sheet, usually in a margin. In addition, closed loop color registration systems typically require a separate registration mark, spaced from the other registration marks, for each color.

SUMMARY OF THE INVENTION

The inventor of the present invention has recognized that much waste is produced by color registration systems that require registration marks outside printed areas of a sheet, and that require separate, spaced registration marks for each color. The margin containing the registration marks must be removed from the image area, requiring an additional step in the printing process, and further resulting in wasted paper. In addition, use of separate and spaced registration marks for each color utilizes excess space on the web.

The invention provides a method for determining color misregistration in a multi-color printing press having a plurality of printing stations that each include a plate cylinder and that each prints a color image on a web with a predetermined color of ink. The colors printed by the plurality of printing stations cooperate to produce process black. The method includes the steps of identifying an area of the desired image that is intended to be printed in black, and forming registration images on the plate cylinders of the printing stations. The registration images are positioned on the plate cylinders such that, during subsequent printing operations, they will produce color registration marks that cooperate to print a process black registration mark on the web in the identified area when the printing stations are in registration. The method further includes the steps of applying ink to the plate cylinders, forming the color images on the web, examining the identified area with an apparatus capable of distinguishing the colors printed by the printing stations, and generating an error signal if the examining apparatus senses that the color registration marks are not in a desired registration to form the process black registration mark.

The invention further provides a multi-color printing press including a plurality of printing stations, each printing station including a plate cylinder that prints a color image on a web with a predetermined color of ink. The plate cylinders of the printing stations include registration images that are positioned on the plate cylinders such that they will produce color registration marks that cooperate to print a process black registration mark on the web in an identified area when the printing stations are in registry. The printing press further includes examining means capable of distinguishing the colors printed by said printing stations, and means for generating an error signal if the examining means senses that the color registration marks are not in a desired registration to form the process black registration mark.

The invention further provides a method of determining color registration in a multi-color printing press having a plurality of printing stations. The method includes the steps of passing a web through the plurality of printing stations, printing color registration marks that cooperate to print a process black registration mark on the web when the printing stations are in registration, examining the process black registration mark, generating an output signal corresponding with a color variation of the process black registration mark, and generating an error signal if the output signal indicates that the color registration marks are not in a desired registration to form the process black registration mark.

The invention further provides a method comprising the steps of passing a web through the plurality of printing stations, printing a process black registration mark on the web, printing a black ink image on the web adjacent to the process black registration mark, examining the process black registration mark and the black ink image, and generating an error signal if the process black registration mark is not in desired registration relative to the black ink image.

Other features and advantages of the invention will become apparent to those of ordinary skill in the art upon review of the following detailed description, claims, and drawings.

DETAILED DESCRIPTION OF THE PREFERRED EMBODIMENT OF THE INVENTION

Figure 1:
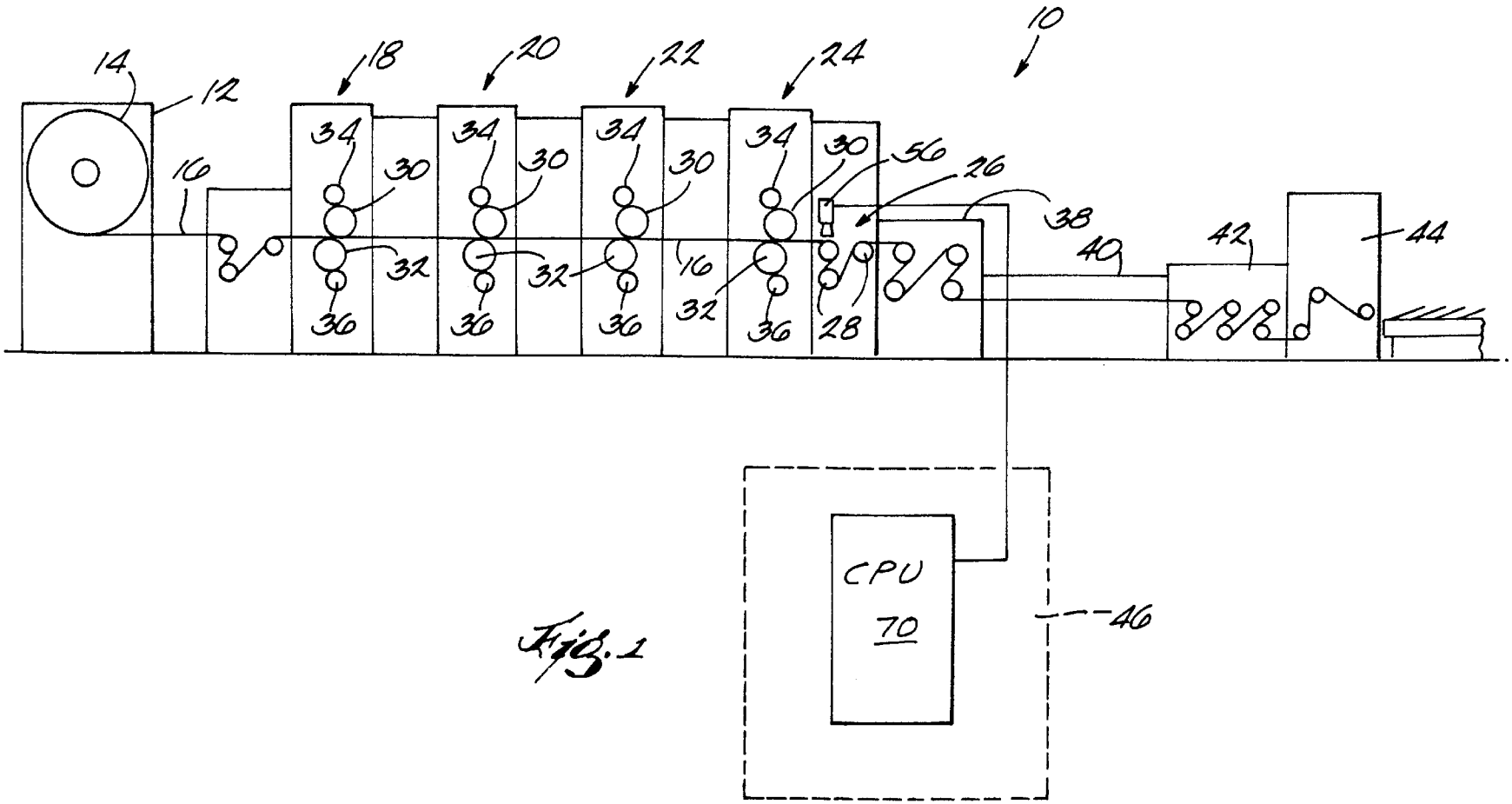
FIG. 1 is a functional block diagram of a printing press embodying various features of the invention.
Figure 2:
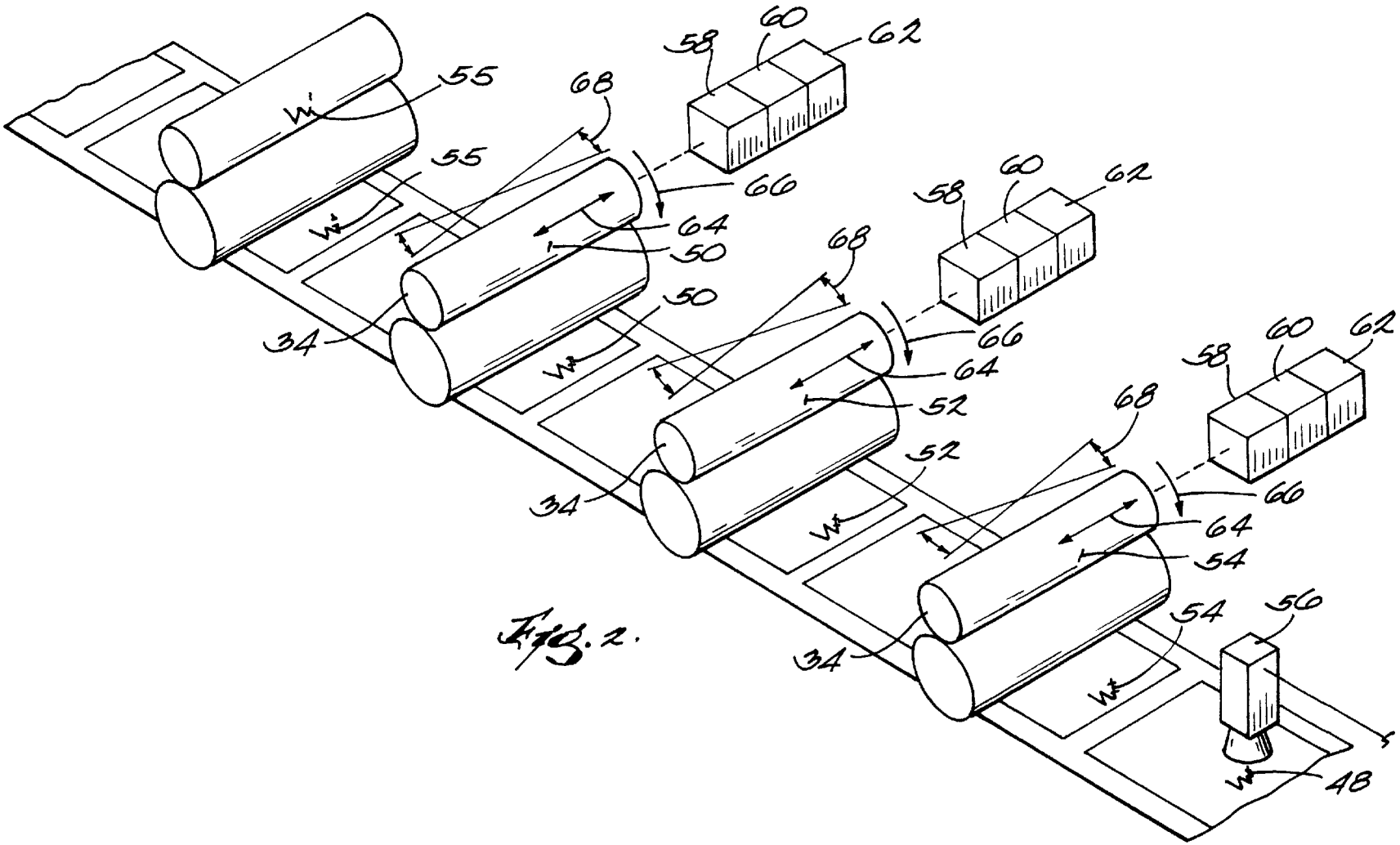
FIG. 2 is a perspective view illustrating printing units of the printing press of FIG. 1, and illustrating a web travelling through the printing units.

Shown in the various figures is a multi-color printing press 10 embodying various features of the invention. The printing press 10 includes a spool support 12 which supports a spool 14 of web material 16 such as paper.

The printing press 10 includes printing stations 18, 20, 22, and 24, each of which prints in a different color. In the illustrated embodiment the first printing station 18 encountered by the web 16 prints with black ink, and the other printing stations 20, 22 and 24 print with other colors. For example, in the illustrated embodiment, the printing station 20 prints in magenta ink, the printing station 22 prints in cyan ink, and the printing station 24 prints in yellow ink. It should be understood, however, that the invention is capable of being carried out with printing stations that print in different colors, or with more printing stations. The printing press 10 includes a drive system 26, including drive rollers 28, that moves the web material 16 from the spool 14 through each of the printing stations 18, 20, 22, and 24. The images printed by the printing stations overlap to define composite multi-color images on the travelling web 16.

Each printing station 18, 20, 22, and 24 includes a pair of parallel rotatable blanket cylinders 30 and 32 that nip therebetween the web 16. Each printing station 18, 20, 22, and 24 further includes a plate cylinder 34 which has a printing plate thereon, and which applies an ink image to the blanket cylinder 30. Optionally, if it is desired to print both sides of the web 16, each printing station 18, 20, 22, and 24 will further include a plate cylinder 36 which has a printing plate thereon, and which applies an ink image to the blanket cylinder 32. The blanket cylinders 30 and 32 transfer the ink images, received from the plate cylinders 34 and 36, to the web 16.

After exiting the printing stations 18, 20, 22, and 24, the web 16 is guided through various components as desired, such as a dryer 38, a chill stand 40, a coating machine 42, and a former/folder 44.

For simplicity, registration control for images on only one side of the web 16 will be hereinafter described. It should be understood, however, that registration control for images on the other side of the web 16 can be carried out by simply duplicating structure and the steps that will be hereinafter described.

The printing press 10 further includes a registration control system 46 which maintains registry of the images printed on one side of the web 16 by the separate printing stations 18, 20, 22, and 24. The registration control system 46 determines the extent of misregistration between the images printed by the printing stations 18, 20, 22, and 24, and generates signals for appropriately adjusting the printing stations 18, 20, 22, and 24, as described in more detail below.

Figure 3:
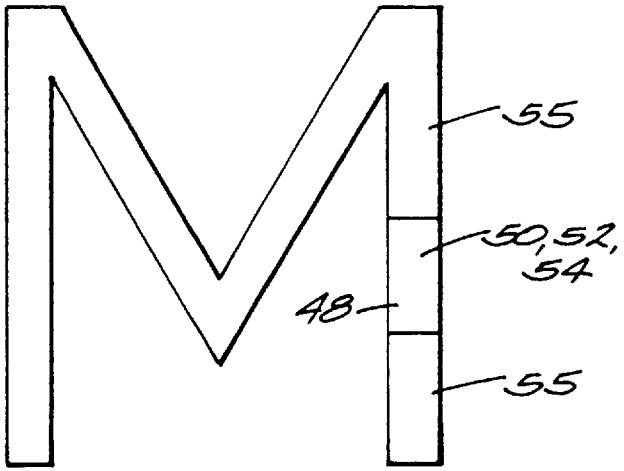
FIG. 3 is an enlarged view illustrating register indicia on a final product printed by the printing press of FIG. 1 when printing units are in registry with one another.

Instead of printing registration marks in a margin or non-image area that is normally separated from the finished printed product, a novel registration mark 48 is printed in the image portion of the web. An area or spot in the image portion that is normally printed with black ink is identified and is instead printed with process black. For example, a portion of the printed letter or character is printed with process black (see FIG. 3) instead of black, as would normally be expected. Process black results from printing colors, such a cyan, yellow, and magenta, over one another. Thus, to define the registration mark 48, the printing stations 20, 22, and 24 print marks 50, 52, and 54, respectively, one over the other.

More particularly, during press set up, respective mark images are formed on the respective plate cylinders 34 of the printing stations 20, 22, and 24. The mark images are positioned on the plate cylinders 34 such that they will print registration marks 50, 52, and 54, respectively, one on top of the other to define the process black composite registration mark 48 on the web 16 in the identified area when the printing stations 18, 20, 22, and 24 are in registry. Further, the mark images are positioned on the plate cylinders 34 of respective printing stations 20, 22, and 24 such that the printing stations 20, 22, and 24 will print the registration marks 50, 52, and 54 one on top of the other so that the process black registration mark 48 is aligned and continuous with a mark 55 printed in black ink by the printing station 18 when all of the printing stations 18, 20, 22, and 24 are in registry with one another.

A human observer of the finished product is not able to distinguish the process black registration mark 48 from the black ink. This is particularly true because only a small portion of the image area is printed with process black (e.g., only a portion of one alpha-numeric character on a page of a magazine, book, or newspaper, is printed with process black).

The registration control system 46 further includes an electronic viewing device 56 which is capable of distinguishing the colors printed by the printing stations 20, 22, and 24, and which is capable of distinguishing process black from black ink printed by the printing station 18. The viewing device 56 could be a color camera such as a color video camera, a densitometer, a spectrograph or other device employing a CCD array or photodiodes, or other appropriate viewing device. In the preferred embodiment, the viewing device 56 is a combination color and infrared camera utilizing CCD arrays. Such a camera can be produced by adding an infrared channel to a standard color CCD camera. For example, a dichroic mirror can be used to pass visible light to a standard CCD array, and to reflect infrared light to an appropriate infrared CCD array. In some cases the infrared filter from the camera may need to be removed and an infrared pass filter may need to be added. The viewing device 56 is positioned to view the area containing the registration marks printed by the printing stations 20, 22, and 24 after the web 16 exits all of the printing stations. A system capable of performing the functions of the present invention is set forth in U.S. Pat. No. 5,412,577, which is incorporated herein by reference in its entirety.

Each printing station further includes adjusting mechanisms 58, 60, and 62 for adjusting the plate cylinder 34 of that printing station in longitudinal, circumferential, and skew directions, respectively. The longitudinal, circumferential, and skew directions are indicated by arrows 64, 66, and 68, respectively. Each adjusting mechanism 58, 60, and 62 includes a motor, hydraulics, or other suitable movement effecting structure for adjusting the plate cylinder 34. Such adjusting mechanisms are well-known in the art, as evidence by U.S. Pat. No. 3,806,012 to Roch, which is hereby incorporated by reference in its entirety.

The registration control system 46 includes a computer or microprocessor 70, that receives image data from the viewing device 56 and that calculates or determines by how much the plate cylinder 34 of each printing station 18, 20, 22 or 24 that is out of register should be adjusted in the longitudinal, circumferential, and skew directions 64, 66, and 68, respectively. More particularly, the computer determines whether the viewing device 56 indicates a color (i.e., something other than process black) where the process black composite registration mark 48 is expected. If so, appropriate calculations are made for adjusting the printing station 20, 22, or 24 that prints in the color (magenta, cyan, or yellow) that is not lined up with the other registration marks 50, 52, or 54. The computer 70 also determines whether the viewing device 56 indicates that the process black registration mark is aligned and contiguous with black ink printed by the black printing station 18. If not, the computer 70 makes appropriate calculations for adjusting the black printing station 18.

One method and apparatus for making calculations for adjusting a printing station is disclosed in U.S. Pat. No. 4,887,530, issued to Sainio on Dec. 19, 1989, assigned to the assignee of the present invention, and incorporated herein by reference. In order to make appropriate calculations for adjusting the printing station 18, the computer or microprocessor 70 determines the center 72 of the process black area where the register marks 50, 52, and 54 overlap, determines the width w and length of 1 of the process black area where the register marks 50, 52, and 54 overlap, and determines the distance d from the center 72 to the black ink mark 55. If the measured values for width w, length 1 and distance d fall outside of a predetermined tolerance from a predetermined value, the microprocessor will know that corrections need to be made.

Figure 4:
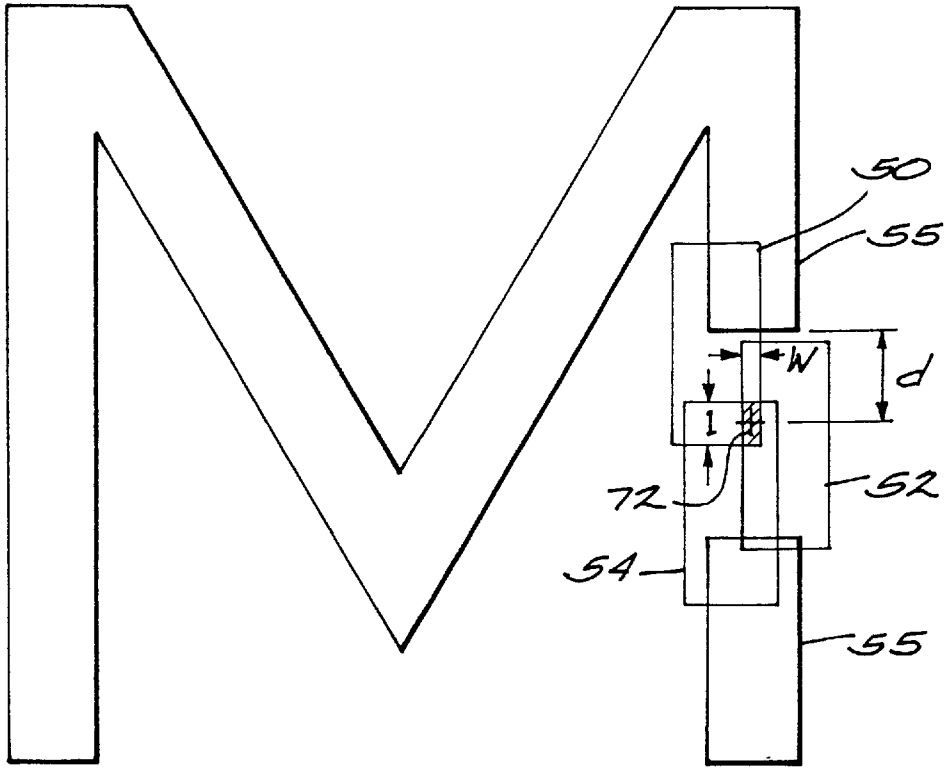
FIG. 4 is a view, more greatly enlarged than FIG. 3, illustrating register indicia on a final product printed by the printing press of FIG. 1 when printing units are not in registry with one another.

The computer or microprocessor 70 communicates with the adjusting mechanisms 68, 58, and 62 of each printing station 18, 20, 22, or 24 to move the plate cylinder 34 of each out of register printing station in the longitudinal, circumferential, and skew directions 64, 66, and 68, based on the calculated amounts, so as to bring the printing stations 18, 20, 22, and 24 in registry with one another. For example, if based upon information received from the viewing device 56, the microprocessor 70 determines that the cyan mark 52 is only present at one of the four corners of the identified area, as shown in FIG. 4, then the microprocessor will know that the printing press that prints the cyan color will need to be adjusted to move the cyan mark 52 appropriately. The same process can be performed for each of the colors until the values for w, 1 and d are within the predetermined acceptable range.

It should be appreciated that, once the specifics of the error are detected, the method for correcting the error can be performed in many different ways and using many different apparatuses, as is generally known in the art, and as evidenced by the patents incorporated by reference into this patent application.

Thus, the invention provides a color registration system wherein it is not necessary to provide a margin for registration marks, and wherein a human viewer of the final printed product is not aware that the final printed product contains a registration mark.

While a preferred embodiment of the invention has been described, various modifications are possible. Thus, the scope of the invention is to be limited only by the scope and spirit of the following claims.

What is claimed is:

1. A method of determining color misregistration in a multi-color printing press having a plurality of printing stations that each include a plate cylinder and that each prints a color image on a web with a predetermined color of ink, wherein the colors printed by the plurality of printing stations cooperate to produce process black, said method comprising the steps of:

identifying an area of the desired image that is intended to be printed in black;

forming registration images on the plate cylinders of the printing stations, said registration images being positioned on the plate cylinders such that, during subsequent printing operations, they will produce color registration marks that cooperate to print a process black registration mark on the web in the identified area when the printing stations are in registration;

applying ink to the plate cylinders;

forming the color images on the web;

examining the identified area with an apparatus capable of distinguishing the colors printed by the printing stations; and generating an error signal if the examining apparatus senses that the color registration marks are not in a desired registration to form the process black registration mark.

2. A method as set forth in claim 1, wherein the multi-color printing press further includes a black printing station that prints black ink, wherein the mark images are positioned on the plate cylinders so that the process black registration mark is contiguous with the black ink printed by the printing station that prints in black ink when the printing stations are in registry with one another.

3. A method as set forth in claim 1, further comprising the step of determining the amount by which at least one of the printing stations should be adjusted to move the printing station toward proper registration.

4. A method as set forth in claim 3, further comprising the step of adjusting the orientation of the printing station that is out of registry.

5. A multi-color printing press comprising:

a plurality of printing stations, each printing station including a plate cylinder that prints a color image on a web with a predetermined color of ink, said plate cylinders of said printing stations having registration images that are positioned on said plate cylinders such that they will produce color registration marks that cooperate to print a process black registration mark on the web in an identified area when said printing stations are in registry;

examining means capable of distinguishing the colors printed by said printing stations, said examining means being positioned to view the identified area; and means for generating an error signal if said examining means senses that the color registration marks are not in a desired registration to form the process black registration mark.

6. A multi-color press as set forth in claim 5, further comprising a black printing station that prints black ink, and wherein the images are positioned on said plate cylinders so that the process black registration mark is contiguous with the black ink printed by said black printing station when said printing stations are in registry with one another.

7. A multi-color press as set forth in claim 5, further comprising microprocessor means for determining how much said plate cylinder of said printing station that is out of registry should be adjusted.

8. A multi-color press as set forth in claim 7, further comprising adjusting means for adjusting the orientation of said printing station that is out of registry.

9. A method of determining color registration in a multi-color printing press having a plurality of printing stations, comprising the steps of:

passing a web through the plurality of printing stations;

printing color registration marks that cooperate to print a process black registration mark on the web when the printing stations are in registration;

examining the process black registration mark;

generating an output signal corresponding with a color variation of the process black registration mark; and generating an error signal if the output signal indicates that the color registration marks are not in a desired registration to form the process black registration mark.

10. A method as set forth in claim 9, wherein said step of generating an error signal comprises the steps of:

analyzing the output signal; and determining whether any one of the color registration marks is misaligned with the other color registration marks.

11. A method as set forth in claim 9, further comprising the step of printing a black ink image adjacent to the process black registration mark.

12. A method as set forth in claim 11, further comprising the steps of:

analyzing the output signal; and determining whether the black ink image is contiguous with the process black registration mark.

13. A method as set forth in claim 9, further comprising the step of determining an amount by which any of said printing stations should be adjusted to improve the position of the process black registration mark.

14. A method as set forth in claim 13, further comprising the step of adjusting an orientation of said printing station that is out of registry.

15. A method as set forth in claim 13, wherein said step of determining comprises the steps of:

analyzing the output signal; and ascertaining the color of predetermined locations in the identified area.

16. A method of determining color registration in a multi-color printing press having a plurality of printing stations, comprising the steps of:

passing a web through the plurality of printing stations;

printing a process black registration mark on the web;

printing a black ink registration mark on the web adjacent to the process black registration mark;

examining the process black registration mark and the black ink registration mark; and generating an error signal if the process black registration mark is not in desired registration relative to the black ink registration mark.

17. A method as set forth in claim 16, wherein said step of generating an error signal occurs when the process black registration mark is not contiguous with the black ink registration mark.

18. A method as set forth in claim 16, wherein both the process black registration mark and the black ink registration mark form a portion of a composite registration mark printed on the web.

19. A method as set forth in claim 16, wherein said step of printing a process black registration mark comprising the step of printing color registration marks on top of each other.

20. A method as set forth in claim 19, further comprising the step of generating an error signal if the color registration marks are not in desired registration with each other.

* * * * *